US008230712B2

(12) United States Patent
Lee

(10) Patent No.: US 8,230,712 B2
(45) Date of Patent: Jul. 31, 2012

(54) PUNCHING DEVICE

(76) Inventor: Chung-Yi Lee, Hsin-Tien (TW)

( * ) Notice: Subject to any disclaimer, the term of this patent is extended or adjusted under 35 U.S.C. 154(b) by 287 days.

(21) Appl. No.: 12/784,959

(22) Filed: May 21, 2010

(65) Prior Publication Data

US 2011/0283764 A1 Nov. 24, 2011

(51) Int. Cl.
*B21D 28/00* (2006.01)
*B26D 7/26* (2006.01)

(52) U.S. Cl. ..... 72/332; 72/430; 83/698.21

(58) Field of Classification Search ..... 72/430, 72/707, 326, 328, 332, 333, 337; 83/698.21, 83/684–691
See application file for complete search history.

(56) References Cited

U.S. PATENT DOCUMENTS

| | | | | |
|---|---|---|---|---|
| 7,011,009 | B1 * | 3/2006 | Tomich | 83/696 |
| 7,392,730 | B2 * | 7/2008 | Kim et al. | 83/687 |
| 2007/0007327 | A1 * | 1/2007 | Kim et al. | 234/109 |
| 2008/0295666 | A1 * | 12/2008 | Bae | 83/687 |
| 2010/0206152 | A1 * | 8/2010 | Oh | 83/687 |

* cited by examiner

*Primary Examiner* — Faye Francis
(74) *Attorney, Agent, or Firm* — The Webb Law Firm

(57) ABSTRACT

A punching device includes: a lower part including a die; an upper part including a punch support attached magnetically to the die; a punch supported movably on the punch support; and a separating mechanism including a driving unit mounted rotatably on one of the upper and lower parts and rotatable relative to the upper and lower parts, and a pressing unit mounted movably on the one of the upper and lower parts and associated with the driving unit in such a manner that when an external force is applied to the driving unit for rotating the driving unit relative to the upper and lower parts, the external force can be transferred from the driving unit to the pressing unit to allow the pressing unit to press against the other of the upper and lower parts.

10 Claims, 4 Drawing Sheets

PUNCHING DEVICE

BACKGROUND OF THE INVENTION

1. Field of the Invention

This invention relates to a punching device, more particular to a punching device including a separating mechanism for separating a punch support from a die which is magnetically attached to the punch support.

2. Description of the Related Art

FIG. 1 illustrates a conventional punching device that is used in the craft industry for cutting a sheet member in a predetermined pattern to form a craft article. The punching device includes a die base 1, a punch support 22 attached magnetically to the die base 1 through magnets 31, a punch 232 supported on the punch support 22 through a plurality of urging members 242, a cover 21 covering the punch 232, and an operating button 241 extending through the cover 21 and in contact with a top of the punch 232. The operating button 241 is operable for driving the punch 232 to punch a workpiece 300 disposed between a bottom of the punch support 22 and a top of the die base 1. The punch support 22 and the die base 1 are separated from each other so as to permit removal of the workpiece 300 therefrom after punching. The magnetic force provided by the magnets 31 is required to be sufficient to permit precise alignment between the punch support 22 and the die base 1 during assembly thereof and to prevent undesired relative movement between the punch support 22 and the die base 1 during punch. As a consequence, separation of the punch support 22 from the die base 1 normally requires the user to rotate one of the punch support 22 and the die base 1 relative to the other or to lift one end of one of the punch support 22 and the die base 1 away from one end of the other of the punch support 22 and the die base 1 while pressing the other end of said one of the punch support 22 and the die base 1 against the other end of the other of the punch support 22 and the die base 1, which is laborious and is likely to cause undesired folding and damage of the workpiece 300.

SUMMARY OF THE INVENTION

Therefore, an object of the present invention is to provide a punching device that can overcome the aforesaid drawbacks associated with the prior art.

According to the present invention, there is provided a punching device that comprises: a lower part including a die adapted to support a workpiece thereon; an upper part including a punch support attached magnetically to the die; a punch supported movably on the punch support so as to be slidable against the die to cut the workpiece; and a separating mechanism including a driving unit mounted rotatably on one of the upper and lower parts and rotatable relative to the upper and lower parts, and a pressing unit mounted movably on said one of the upper and lower parts and associated with the driving unit in such a manner that when an external force is applied to the driving unit for rotating the driving unit relative to the upper and lower parts, the external force can be transferred from the driving unit to the pressing unit to allow the pressing unit to press against the other of the upper and lower parts in order to overcome a magnetically attracting force between the punch support and the die to thereby separate the upper and lower parts from each other.

BRIEF DESCRIPTION OF THE DRAWINGS

In drawings which illustrate an embodiment of the invention.

DETAILED DESCRIPTION OF THE PREFERRED EMBODIMENT

Figure 1:
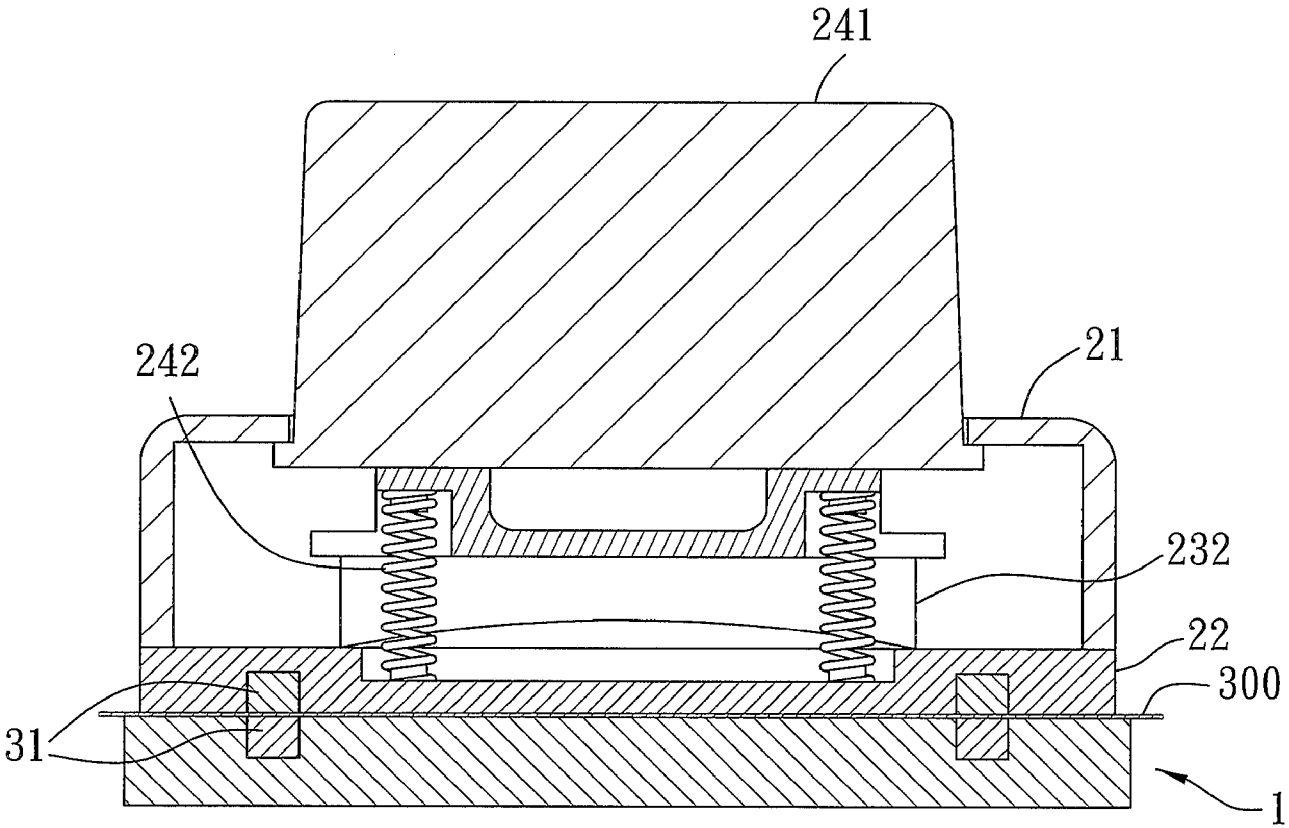
FIG. 1 PRIOR ART
FIG. 1 is a sectional view of a conventional punching device.
Figure 2:
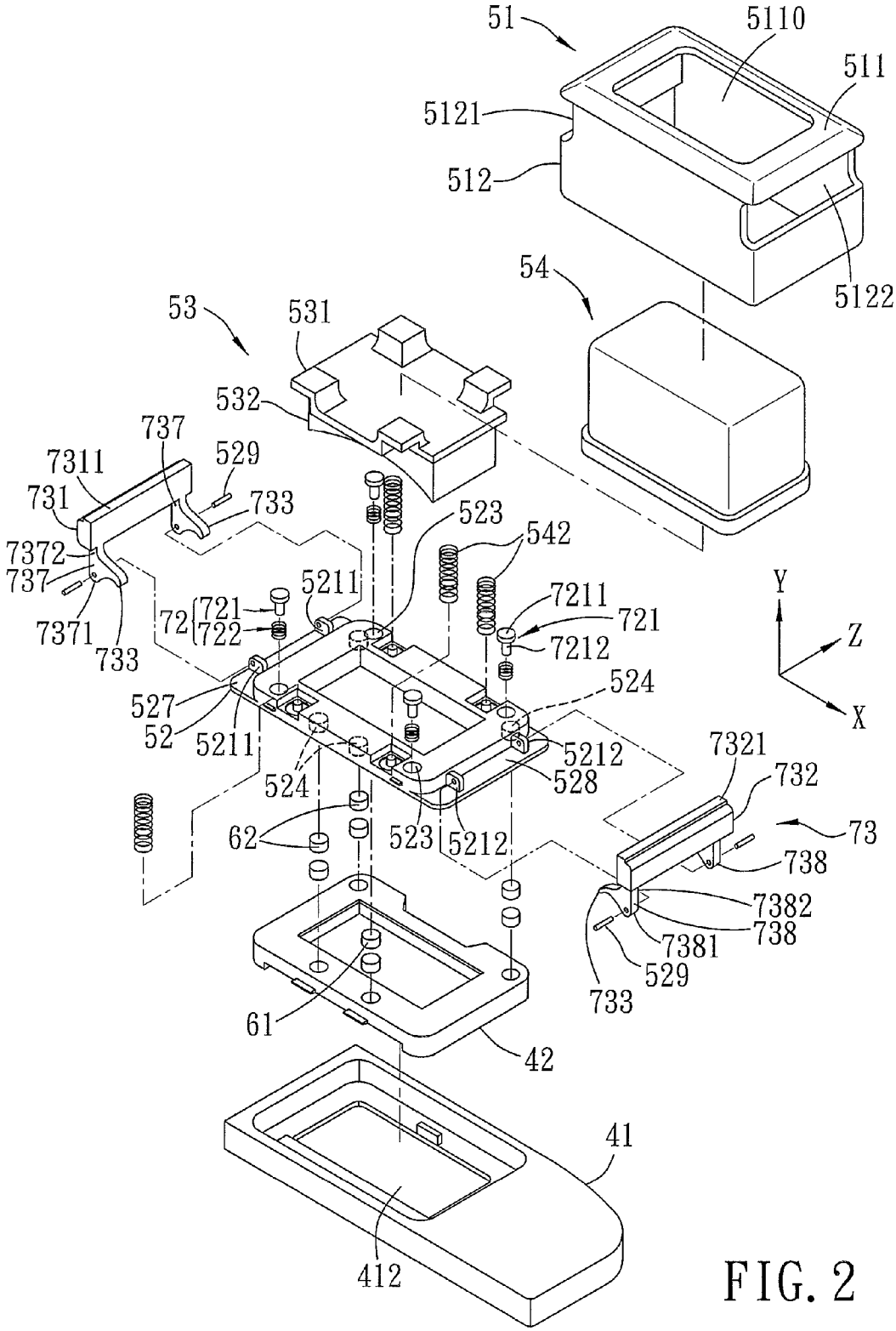
FIG. 2 is an exploded perspective view of the preferred embodiment of a punching device according to this invention.
Figure 3:
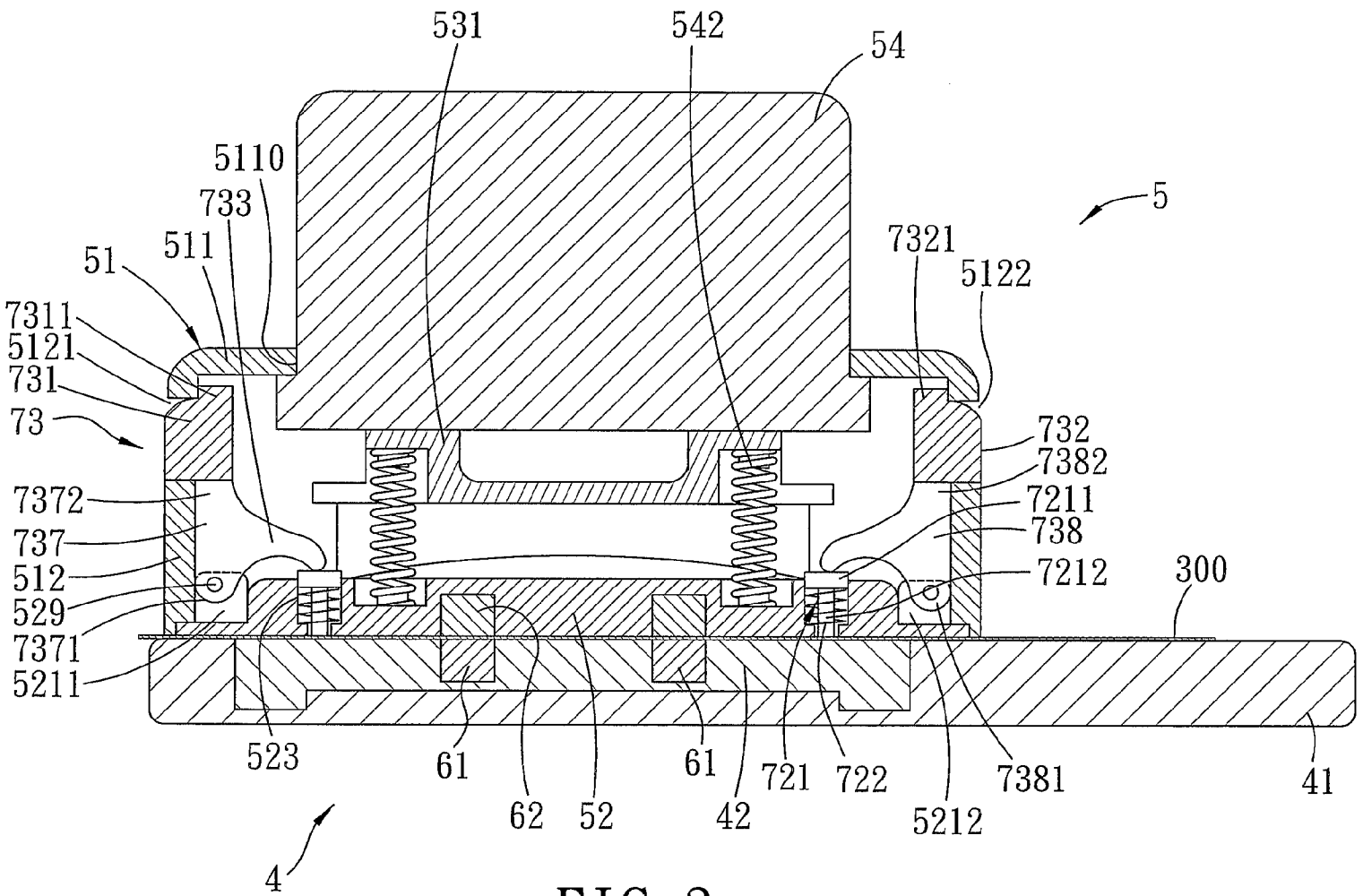
FIG. 3 is a sectional view of the preferred embodiment, illustrating a state where a driving unit is disposed at a first angular position and a die is magnetically attached to a punch support.
Figure 4:
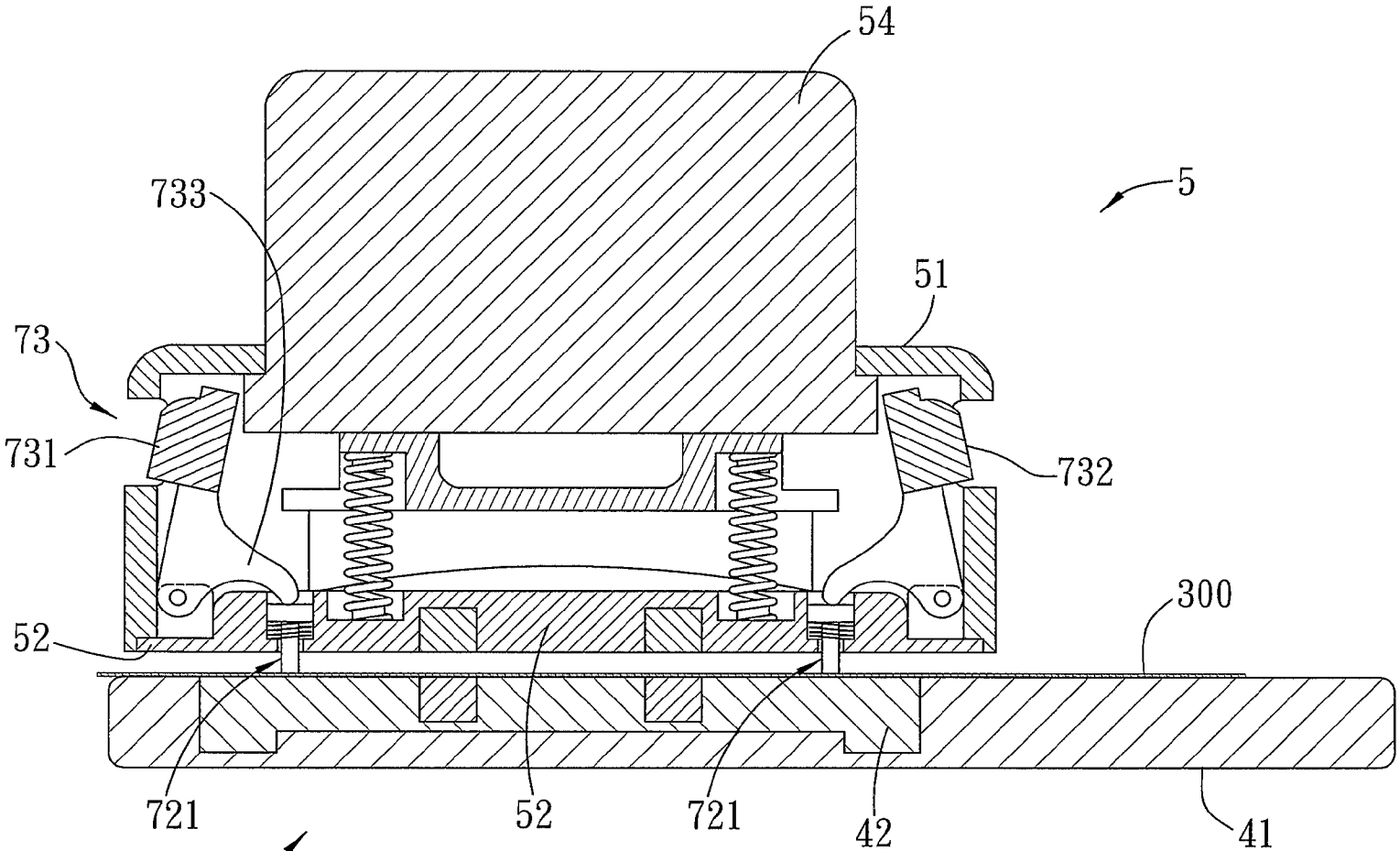
FIG. 4 is a sectional view of the preferred embodiment, illustrating another state where the driving unit is disposed at a second angular position and the die is separated from the punch support.

Referring to FIGS. 2 to 4, the preferred embodiment of a punching device, that is adapted to be used in the craft industry for cutting a workpiece 300 to form a craft article, according to the present invention is shown to include: a lower part 4 including a die base 41 and a die 42 mounted in a recess 412 in the die base 41, adapted to support the workpiece 300 thereon and provided with a plurality of first magnets 61; an upper part 5 including a punch support 52 provided with a plurality of second magnets 62 so as to be attached magnetically to the die 42, a cover 51 for covering the punch 53, and a push button 54; a punch 53 supported movably on the punch support 52 so as to be slidable against the die 42 to cut the workpiece 300; a plurality of urging elements 542 for restoring the punch 53 to its original position (see FIG. 3); and a separating mechanism including a driving unit 73 mounted rotatably on the punch support 52 of the upper part 5, and a pressing unit 72 mounted movably on the punch support 52 of the upper part 5 and associated with the driving unit 73 in such a manner that when an external force is applied to the driving unit 73 for rotating the driving unit 73 relative to the upper and lower parts 4, 5, the external force can be transferred from the driving unit 73 to the pressing unit 72 to allow the pressing unit 72 to press against the die 42 of the lower part 4 in order to overcome a magnetically attracting force between the punch support 52 and the die 42 to thereby separate the upper and lower parts 4, 5 from each other.

The structures of the driving unit 73 and the pressing unit 72 and how the pressing unit 72 can be driven by the driving unit 73 to press against the die 42 are described in a greater detail in the following.

In this embodiment, the punch support 52 and the die 42 are opposite to each other in a pressing direction (Y) when the punch support 52 is attached magnetically to the die 42. The driving unit 73 is pivoted to the punch support 52 so as to be rotatable relative to the punch support 52, and the pressing unit 72 is mounted movably on the punch support 52 so as to be movable relative to the punch support 52 in the pressing direction (Y).

The punch support 52 is formed with a plurality of through-holes 523 extending in the pressing direction (Y). The pressing unit 72 includes a plurality of headed studs 721 extending into the through-holes 523 in the pressing direction (Y), respectively, and a plurality of urging members 722 disposed in the through-holes 523 for restoring the headed studs 721 to their original positions.

The punch support 52 has first and second ends 527, 528 opposite to each other in a first direction (X) transverse to the pressing direction (Y), and is provided with a pair of first joints 5211 disposed at the first end 527 of the punch support 52, a pair of second joints 5212 disposed at the second end 528 of the punch support 52, and a plurality of pivot pins 529.

Either the first joints 5211 or the second joints 5212 are aligned with each other in a second direction (Z) transverse to the first direction (Y) and the pressing direction (X). Each of the headed studs 721 has a head 7211, and a tail 7212 reduced in diameter from the head 7211. The driving unit 73 includes a pair of first base portions 737 and a pair of second base portions 738. Each of the first and second base portions 737, 738 extends in the pressing direction (Y), and has a lower end 7371, 7381 pivoted to a respective one of the first and second joints 5211, 5212 of the punch support 52 through a respective one of the pivot pins 529. Each of the pivot pins 529 is spaced apart from and aligned with the head 7211 of a corresponding one of the headed studs 721 in the first direction (X) when the punch support 52 is attached magnetically to the die 42.

The driving unit 73 further includes a plurality of driving arms 733. Each of the driving arms 733 is disposed above the lower end 7371, 7381 of a respective one of the first and second base portions 737, 738, extends curvedly from the respective one of the first and second base portions 737, 738 to abut against the head 7211 of a respective one of the headed studs 721, and is pivotable for driving movement of the respective headed stud 721 against the urging action of the respective urging member 722. The tail 7212 of each of the headed studs 721 abuts against the die 42 when the punch support 52 is attached magnetically to the die 42.

The punch support 52 is further formed with a plurality of recesses 524 disposed between the pair of the first joints 5211 and the pair of the second joints 5212 and receiving the second magnets 62 therein, respectively. The headed studs 721 are disposed between the pair of the first joints 5211 and the pair of the second joints 5212.

The punch 53 includes an upper wall 531 and a blade member 532 extending downwardly from the upper wall 531 toward the punch support 52. The urging elements 542 are mounted between and abut resiliently against the punch support 52 and the upper wall 531 of the punch 53.

The cover 51 has a top wall 511 disposed above the upper wall 531 of the punch 53, and a surrounding wall 512 extending downwardly from a periphery of the top wall 511 to surround the punch 53 and the driving arms 733. The top wall 511 is formed with a top opening 5110. The push button 54 extends through the top opening 5110, is seated on the upper wall 531 of the punch 53, and is operable for driving movement of the punch 53 against the urging action of the urging elements 542 toward the die 42.

The surrounding wall 512 is formed with first and second side holes 5121, 5122 opposite to each other in the first direction (X). Each of the first and second base portions 737, 738 further has an upper end 7372, 7382 disposed above a respective one of the driving arms 733. The driving unit 73 further includes first and second operating knobs 731, 732. The first operating knob 731 interconnects the upper ends 7372 of the first base portions 737 and protrudes into the first side hole 5121 and the second operating knob 732 interconnects the upper ends 7382 of the second base portions 738 and protrudes into the second side hole 5122 when the punch support 52 is attached magnetically to the die 42.

Each of the first and second operating knobs 731, 732 has an end stopper 7311, 7321 abutting against a wall of the cover 51 defining the respective one of the first and second side holes 5121, 5122 to prevent removal of a corresponding one of the first and second operating knobs 731, 732 from the cover 51 through a corresponding one of the first and second side holes 5121, 5122.

In operation, as illustrated in FIG. 4, when the workpiece 300 is to be released from the die 42 and the punch support 52 after punching, the first and second operating knobs 731, 732 can be easily pushed toward each other by the thumb and the index finger of the user to cause the driving arms 733 to press the headed studs 721 against the die 42 in an extent to overcome the magnetically attracting force between the first magnets 61 on the die 42 and the second magnets 62 on the punch support 52 so as to separate the die 42 from the punch support 52.

The aforesaid preferred embodiment may be modified in such a manner, but are not limited to, that the driving unit 73 and the pressing unit 72 can be mounted movably on the die 42 of the lower part 4 instead, that the driving unit 73 and the pressing unit 72 can be integrally formed into a single piece, that the driving unit 73 can be pivoted to the cover 51, and that only one urging element 542 is used for urging the punch 53. When only one urging element 542 is to be used in the punching device, the urging element 542 can be configured to surround the punch 53.

With the inclusion of the separating mechanism in the punching device of this invention, the aforementioned drawbacks associated with the prior art can be eliminated.

With the invention thus explained, it is apparent that various modifications and variations can be made without departing from the spirit of the present invention.

What is claimed is:

1. A punching device comprising:

a lower part including a die adapted to support a workpiece thereon;

an upper part including a punch support attached magnetically to said die;

a punch supported movably on said punch support so as to be slidable against said die to cut the workpiece; and a separating mechanism including a driving unit mounted rotatably on one of said upper and lower parts and rotatable relative to said upper and lower parts, and a pressing unit mounted movably on said one of said upper and lower parts and associated with said driving unit in such a manner that when an external force is applied to said driving unit for rotating said driving unit relative to said upper and lower parts, the external force can be transferred from said driving unit to said pressing unit to allow said pressing unit to press against the other of said upper and lower parts in order to overcome a magnetically attracting force between said punch support and said die to thereby separate said upper and lower parts from each other.

2. The punching device of claim 1, wherein said punch support and said die are opposite to each other in a pressing direction when said punch support is attached magnetically to said die, said driving unit being pivoted to said punch support so as to be rotatable relative to said punch support, said pressing unit being mounted movably on said punch support so as to be movable relative to said punch support in the pressing direction.

3. The punching device of claim 2, wherein said punch support is formed with a plurality of through-holes extending in the pressing direction, said pressing unit including a plurality of headed studs extending into said through-holes in the pressing direction, respectively, and a plurality of urging members disposed in said through-holes for restoring said headed studs to their original positions, said driving unit abutting against said headed studs and being operable for driving movement of said headed studs against the urging action of said urging members.

4. The punching device of claim 3, wherein said punch support has first and second ends opposite to each other in a first direction transverse to the pressing direction, and is provided with a pair of first joints disposed at said first end of said punch support, a pair of second joints disposed at said second end of said punch support, and a plurality of pivot pins, said first joints being aligned with each other in a second direction transverse to the first direction and the pressing direction, said second joints being aligned with each other in the second direction, each of said headed studs having a head, and a tail reduced in diameter from said head, said driving unit including a pair of first base portions and a pair of second base portions, each of said first and second base portions extending in the pressing direction, and having a lower end pivoted to a respective one of said first and second joints of said punch support through a respective one of said pivot pins, each of said pivot pins being spaced apart from and aligned with said head of a corresponding one of said headed studs in the first direction when said punch support is attached magnetically to said die.

5. The punching device of claim 4, wherein said driving unit further includes a plurality of driving arms, each of which is disposed above said lower end of a respective one of said first and second base portions and extends curvedly from the respective one of said first and second base portions to abut against said head of a respective one of said headed studs, said tail of each of said headed studs abutting against said die when said punch support is attached magnetically to said die.

6. The punching device of claim 5, further comprising a plurality of magnets, said punch support being further formed with a plurality of recesses disposed between the pair of said first joints and the pair of said second joints and receiving said magnets therein, respectively, said headed studs being disposed between the pair of said first joints and the pair of said second joints.

7. The punching device of claim 6, further comprising at least one urging element, said punch including an upper wall and a blade member extending downwardly from said upper wall toward said punch support, said urging element being mounted between and abutting resiliently against said punch support and said upper wall of said punch.

8. The punching device of claim 7, wherein said upper part further includes a cover and a push button, said cover having a top wall disposed above said upper wall of said punch, and a surrounding wall extending downwardly from a periphery of said top wall to surround said punch and said first and second driving arms, said top wall being formed with a top opening, said push button extending through said top opening and being seated on said upper wall of said punch, said push button being operable for driving movement of said punch toward said die.

9. The punching device of claim 8, wherein said surrounding wall is formed with first and second side holes opposite to each other in the first direction, each of said first and second base portions further having an upper end disposed above a respective one of said driving arms, said driving unit further including first and second operating knobs, said first operating knob interconnecting said upper ends of said first base portions and protruding into said first side hole and said second operating knob interconnecting said upper ends of said second base portions and protruding into said second side hole when said punch support is attached magnetically to said die.

10. The punching device of claim 9, wherein each of said first and second operating knobs has an end stopper abutting against a wall of said cover defining the respective one of said first and second side holes to prevent removal of a corresponding one of said first and second operating knobs from said cover through a corresponding one of said first and second side holes.

* * * * *